US005678638A

United States Patent [19]

Baker

[11] Patent Number: 5,678,638

[45] Date of Patent: Oct. 21, 1997

[54] SPARK AND FLAME SUPPRESSION SYSTEM

[76] Inventor: Sterling W. Baker, 31 N. 700 E #269, St. George, Utah 84770

[21] Appl. No.: 686,512

[22] Filed: Jul. 26, 1996

[51] Int. Cl.[6] ..... A62C 3/07

[52] U.S. Cl. ..... 169/51; 169/62; 169/26

[58] Field of Search ..... 169/62, 26, 51

[56] References Cited

U.S. PATENT DOCUMENTS

| | | | |
|---|---|---|---|
| 1,838,655 | 12/1931 | Bronander | 169/62 |
| 2,293,366 | 8/1942 | Solosko | 169/26 |
| 2,511,959 | 6/1950 | Williams | 169/62 |
| 2,841,228 | 7/1958 | Porterfield | 169/62 |
| 2,911,049 | 11/1959 | Crouch | 169/62 |
| 3,827,502 | 8/1974 | Lockwood | 169/62 |
| 4,895,208 | 1/1990 | Alasio | 169/26 |

FOREIGN PATENT DOCUMENTS

| | | | |
|---|---|---|---|
| 104452 | 10/1926 | Austria | 169/62 |
| 968634 | 9/1964 | United Kingdom | 169/51 |

*Primary Examiner*—Gary C. Hoge

[57] ABSTRACT

A spark and flame suppression system including an extinguishing member positioned around a contained fire extinguishing material and is securable within an engine compartment of a vehicle.

4 Claims, 3 Drawing Sheets

SPARK AND FLAME SUPPRESSION SYSTEM

BACKGROUND OF THE INVENTION

1. Field of the Invention

The present invention relates to a spark and flame suppression system and more particularly pertains to extinguishing a spark or flame within an engine compartment of a vehicle with a spark and flame suppression system.

2. Description of the Prior Art

The use of vehicle fire extinguisher's is known in the prior art. More specifically, vehicle fire extinguisher's heretofore devised and utilized for the purpose of suppressing fires in a vehicle are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,986,365 to Sheih discloses an automatic fire extinguisher system for a vehicle.

U.S. Pat. No. 4,423,784 to Bolen discloses a vehicle fire extinguisher.

U.S. Pat. No. Des. 342,809 to Thomas discloses the ornamental design for a halon filled aerosol container fire extinguisher.

U.S. Pat. No. 4,763,731 to Adams et al. discloses a fire suppression system for aircraft.

U.S. Pat. No. 4,411,318 to Zeischegg et al. discloses a fire-extinguishing waste receptacle.

U.S. Pat. No. 4,901,594 to Selzer discloses a gas spring assembly for a passenger seat control.

While these devices fulfill their respective, particular objective and requirements, the aforementioned patents do not describe a spark and flame suppression system for extinguishing a spark or flame within an engine compartment of a vehicle.

In this respect, the spark and flame suppression system according to the present invention substantially departs from the conventional concepts and designs of the prior art, and in doing so provides an apparatus primarily developed for the purpose of extinguishing a spark or flame within an engine compartment of a vehicle.

Therefore, it can be appreciated that there exists a continuing need for new and improved spark and flame suppression system which can be used for extinguishing a spark or flame within an engine compartment of a vehicle. In this regard, the present invention substantially fulfills this need.

SUMMARY OF THE INVENTION

To attain this, the present invention essentially comprises an oblong extinguishing member comprised of an elongated and cylindrical housing having rounded end portions and a hollow interior. The hollow interior has a contained fire extinguishing material disposed therein. The oblong extinguishing member includes two base members. Each of the base members is comprised of a generally rectangular block having an arcuate recess formed in top surfaces thereof. Each arcuate recess receives the housing therein inwardly of the rounded end portions thereof. Each block has a pair of upper straps and a pair of lower straps. The pair of upper straps couple around the housing for securement to the blocks. The pair of lower straps couple to a fuel line within the engine compartment of the vehicle. The device includes a frustoconical shaped extinguishing member comprised of a housing having an upper surface, a lower surface and a cylindrical side wall therebetween whereby the upper surface is of a reduced diameter with respect to the lower surface. The housing contains a fire extinguishing material therein. The planar lower surface has securement means thereon for securement of the frustoconical shaped extinguishing member to a rear surface of a radiator of the vehicle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

An object of the present invention is to provide a new and improved spark and flame suppression system for extinguishing a spark or flame within an engine compartment of a vehicle.

Lastly, it is an object of the present invention to provide a new and improved spark and flame suppression system including an extinguishing member positioned around a contained fire extinguishing material and is securable within an engine compartment of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
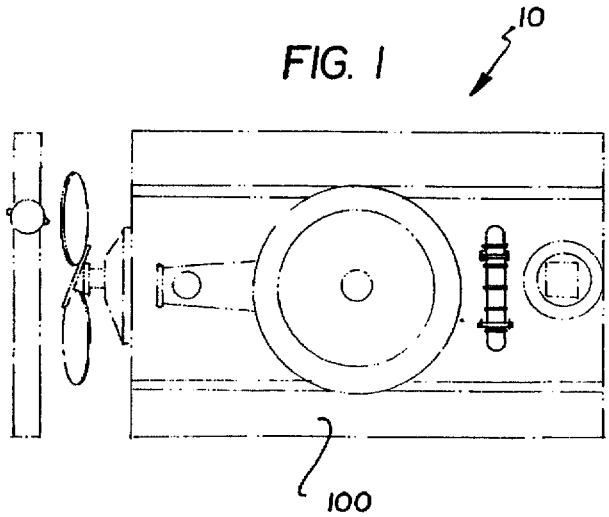
FIG. 1 is a plan view of the preferred embodiment of the spark and flame suppression system constructed in accordance with the principles of the present invention.
Figure 2:
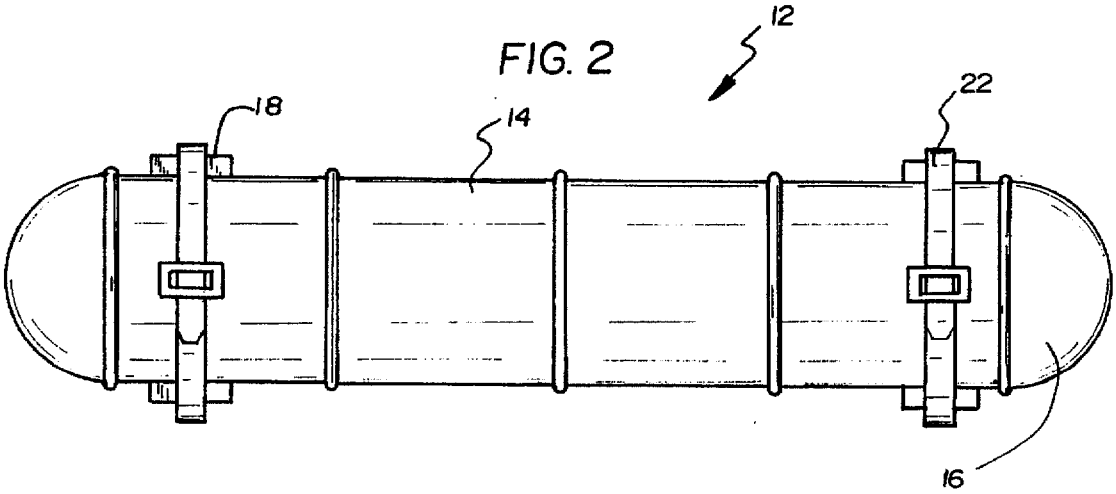
FIG. 2 is a top plan view of the oblong extinguishing member of the present invention.
Figure 3:
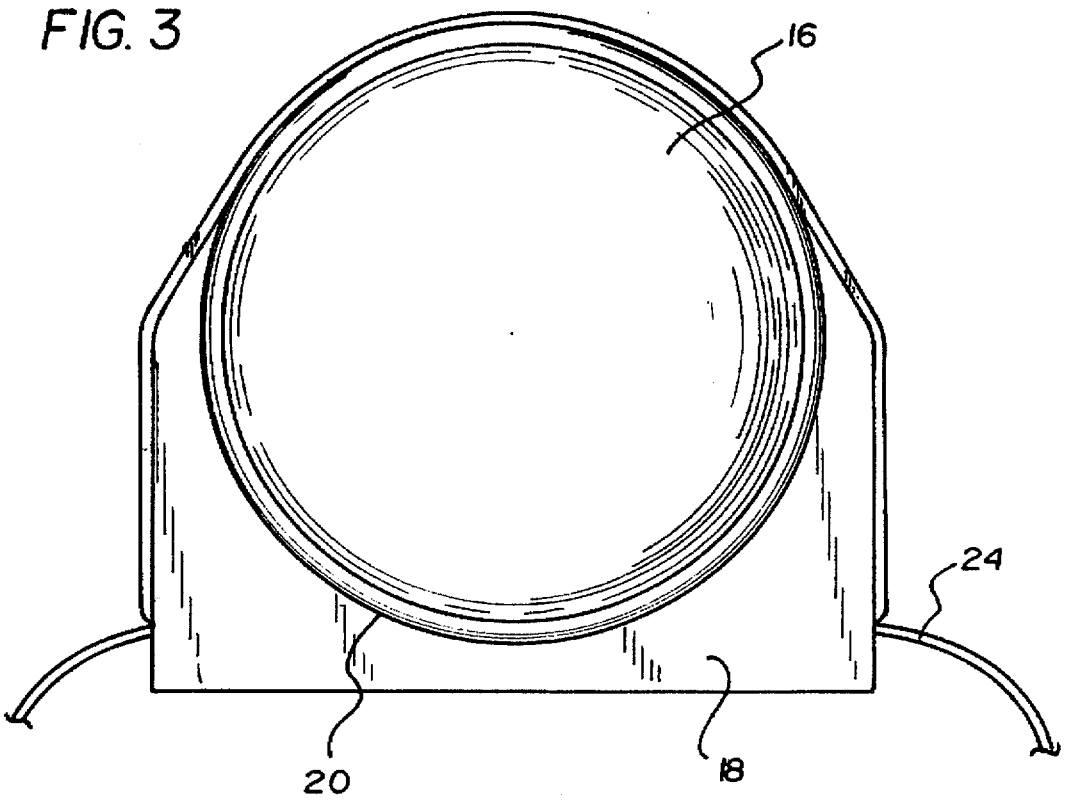
FIG. 3 is a side elevation view of the present invention.
Figure 4:
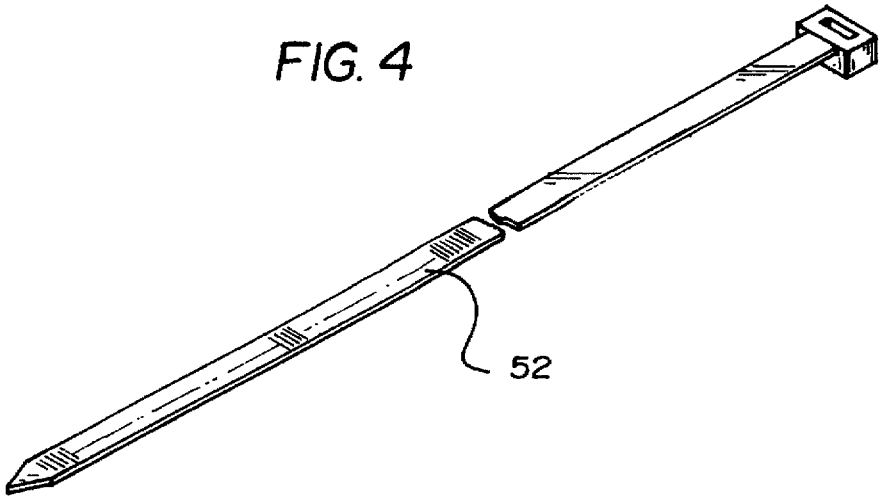
FIG. 4 is a perspective view of the metal mounting strap of the present invention.
Figure 5:
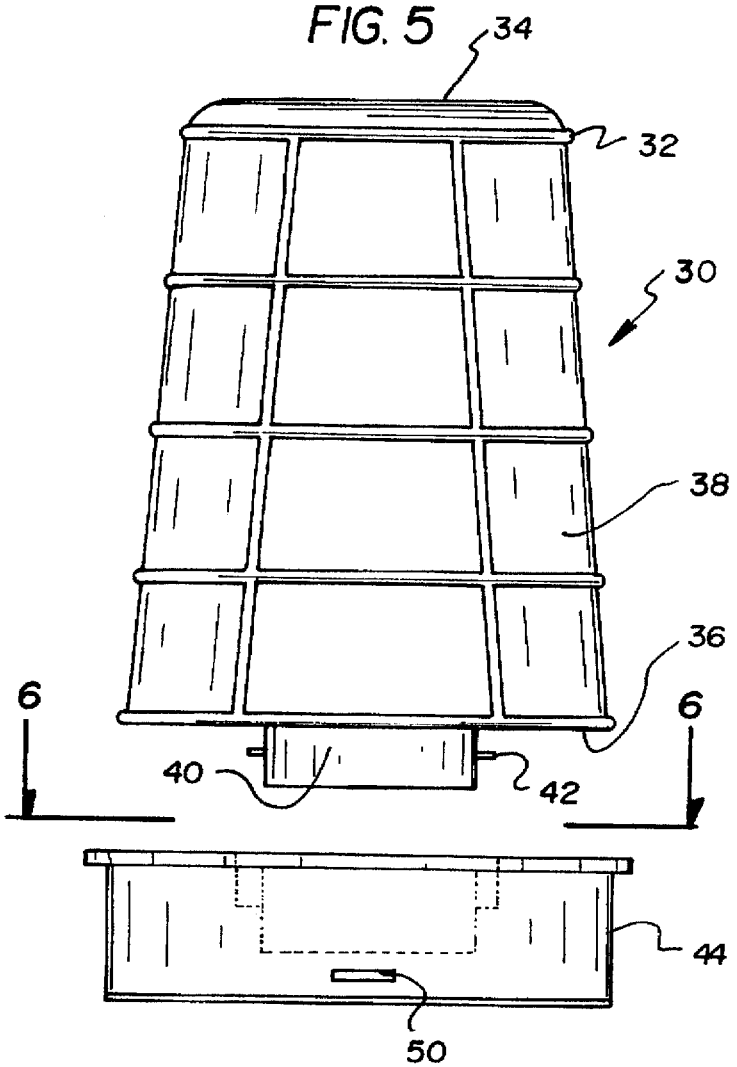
FIG. 5 is a perspective view of the conical shaped extinguishing member of the present invention.
Figure 6:
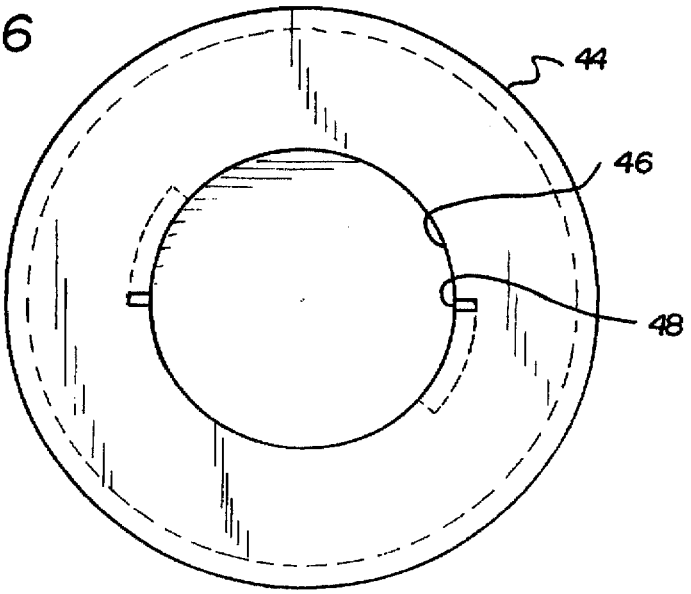
FIG. 6 is a plan view as taken in cross-section along line 6—6 of FIG. 5.

With reference now to the drawings, and in particular, to FIGS. 1–6 thereof, the preferred embodiment of the new and improved spark and flame suppression system embodying the principles and concepts of the present invention and generally designated by the reference number 10 will be described.

Specifically, it will be noted in the various Figures that the device relates to a new and improved spark and flame suppression system for extinguishing a spark or flame within an engine compartment of a vehicle. In its broadest context, the device consists of an oblong extinguishing member and a frustoconical shaped extinguishing member. Such components are individually configured and correlated with respect to each other so as to attain the desired objective.

The device 10 includes an oblong extinguishing member 12 comprised of an elongated and cylindrical housing 14 having rounded end portions 16 and a hollow interior. The hollow interior has a contained fire extinguishing material disposed therein. The oblong extinguishing member 12 includes two base members 18. Each of the base members 18 is comprised of a generally rectangular block having an arcuate recess 20 formed in top surfaces thereof. Each arcuate recess 20 receives the housing 14 therein inwardly of the rounded end portions 16 thereof. Each block has a pair of upper straps 22 and a pair of lower straps 24. The pair of upper straps 22 couple around the housing 14 for securement to the blocks. The pair of lower straps 24 couple to a fuel line within the engine compartment 100 of the vehicle. The fire extinguishing material can be selected from a variety of commercially available fully fluorinated organic compounds that have been shown to effectively extinguish fires. The fire extinguishing material will be contained within the housing 14, which upon heating, will release the fire extinguishing material to extinguish the fire. The housing 14 could alternately be placed within the engine compartment 100 with or without the use of the base members 18. The oblong extinguishing member 12 could also be coupled with electrical lines of a vehicle disposed between a carburetor and distributor and adjacent to a fuel pump thereof. This is an area of the vehicle which is highly prone to fire thereby securing the oblong extinguishing member 12 in this position will provide protection against fire damage to the vehicle's engine.

Associated with the oblong extinguishing member 12, the device 10 includes a frustoconical shaped extinguishing member 30 comprised of a housing 32 having an upper surface 34, a lower surface 36 and a cylindrical side wall 38 therebetween whereby the upper surface 34 is of a reduced diameter with respect to the lower surface 36. The housing 32 contains a fire extinguishing material therein. The lower surface 36 has securement means thereon for securement of the frustoconical shaped extinguishing member 30 to a rear surface of a radiator of the vehicle. The securement means includes a cylindrical member 40 extending downwardly from the lower surface 36 of the housing 32 of the frustoconical shaped extinguishing member 30. The cylindrical member has diametrically opposed spring tabs 42 extending outwardly therefrom. The securement means further includes a base member 44 having a cylindrical recess 46 formed in an upper surface thereof. The cylindrical recess 46 is dimensioned for receiving the cylindrical member 40 therein. The cylindrical recess 46 having a pair of diametrically opposed slots 48 for selectively receiving the spring tabs 42 of the cylindrical member 40 therein for locked engagement of the cylindrical member 40 to the base member 44. The base member 44 has a slotted aperture 50 extending therethrough. A pliable metal securement strap 52 extends through the slotted aperture 50 for securement of the frustoconical shaped extinguishing member 30 to the radiator of the vehicle. The frustoconical shaped extinguishing member 30 is fabricated of plastic, which upon heating, will release the fire extinguishing material to extinguish the fire. The fire extinguishing material can be selected from a variety of commercially available fully fluorinated organic compounds that have been shown to effectively extinguish fires.

The frustoconical shaped extinguishing member 30 is of a fragmentable design for spark suppression as the time of impact or collision. The frustoconical shaped extinguishing member 30 is installed at impact zones such as the radiator or fuel cell (gas tank in rear). The chemical dispersement at the time of impact will treat metal and spray air within the enclosed area.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spark and flame suppression system for extinguishing a spark or flame within an engine compartment of a vehicle comprising, in combination:

an oblong first extinguishing member comprised of an elongated and cylindrical housing having rounded end portions and a hollow interior, the hollow interior having a contained fire extinguishing material disposed therein, the oblong first extinguishing member including two base members, each of the base members comprised of a generally rectangular block having an arcuate recess formed in top surfaces thereof, each arcuate recess receiving the housing therein inwardly of the rounded end portions thereof, each block having a pair of upper straps and a pair of lower straps, the pair of upper straps coupling around the housing for securement to the blocks, the pair of lower straps coupleable to a fuel line within the engine compartment of the vehicle;

a frustoconical shaped second extinguishing member comprised of a housing having an upper surface, a lower surface and a side wall therebetween wherein the upper surface being of a reduced diameter with respect to the lower surface, the housing containing a fire extinguishing material therein, the lower surface having securement means thereon, the securement means coupleable to a rear surface of a radiator of the vehicle.

2. The suppression system as set forth in claim 1 wherein the securement means including a cylindrical member extending downwardly from the lower surface of the housing of the frustoconical shaped second extinguishing member, the cylindrical member having diametrically opposed spring tabs extending outwardly therefrom, the securement means further including a base member having a cylindrical recess formed in an upper surface thereof, the cylindrical recess dimensioned for receiving the cylindrical member therein, the cylindrical recess having a pair of diametrically opposed slots for selectively receiving the spring tabs of the cylindrical member therein for locked engagement of the cylindrical member to the base member, the base member having a slotted aperture extending therethrough, a pliable metal securement strap extends through the slotted aperture, the pliable metal securement strap coupleable to the radiator of the vehicle.

3. A suppression system comprising:

an extinguishing member positioned around a contained fire extinguishing material, and having means for securement within an engine compartment of a vehicle, the extinguishing member is oblong and further comprised of an elongated and cylindrical housing having rounded end portions and a hollow interior, the hollow interior having the contained fire extinguishing material disposed therein, wherein the oblong extinguishing member further including two base members, each of the base members comprised of a generally rectangular block having an arcuate recess formed in top surfaces thereof, each arcuate recess receiving the housing therein inwardly of the rounded end portions thereof, each block having a pair of upper straps and a pair of lower straps, the pair of upper straps coupling around the housing for securement to the blocks, the pair of lower straps coupleable to a fuel line within the engine compartment of the vehicle.

4. The suppression system as set forth in claim 3 and further including a frustoconical shaped second extinguishing member comprised of a housing having an upper surface, a lower surface and a side wall therebetween whereby the upper surface being of a reduced diameter with respect to the lower surface, the housing containing a fire extinguishing material therein, the lower surface having securement means thereon, the securement means coupleable to a rear surface of a radiator of the vehicle.

* * * * *